US007923631B2

(12) United States Patent
Toyama

(10) Patent No.: US 7,923,631 B2
(45) Date of Patent: Apr. 12, 2011

(54) NOISE-CONTROLLABLE HIGH VOLTAGE ELECTRIC WIRE

(75) Inventor: Eiichi Toyama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 191 days.

(21) Appl. No.: 12/285,725

(22) Filed: Oct. 14, 2008

(65) Prior Publication Data

US 2009/0095501 A1 Apr. 16, 2009

(30) Foreign Application Priority Data

Oct. 15, 2007 (JP) ..... 2007-267777

(51) Int. Cl.
*H01B 7/00* (2006.01)

(52) U.S. Cl. ..... 174/36

(58) Field of Classification Search ..... 174/32, 174/33, 34, 36, 102 R, 103, 104, 105 R
See application file for complete search history.

(56) References Cited

U.S. PATENT DOCUMENTS 6,310,286 B1 * 10/2001 Troxel et al. ..... 174/36
6,800,810 B1 * 10/2004 Page ..... 174/102 R
7,446,258 B1 * 11/2008 Sosna et al. ..... 174/33

FOREIGN PATENT DOCUMENTS

JP 06-267348 9/1994
JP 2005-151712 6/2005

* cited by examiner

*Primary Examiner* — William H Mayo, III
(74) *Attorney, Agent, or Firm* — Edwards Angell Palmer & Dodge LLP

(57) ABSTRACT

A noise-controllable high voltage electric wire is formed of a pair of thick high voltage electric wires, through which a large current flows. The pair of thick high voltage electric wires each constitute a plus circuit and a minus circuit. The pair of the thick high voltage electric wires includes: a plurality of thin electric wires for the plus circuit; and a plurality of thin electric wires for the minus circuit. Each thin electric wire for the plus circuit and a corresponding thin electric wire for the minus circuit are twisted together so as to form a plurality of twisted pairs of the electric wires. The plurality of the twisted pairs of the electric wires are bundled up.

4 Claims, 3 Drawing Sheets

FIG. 3A
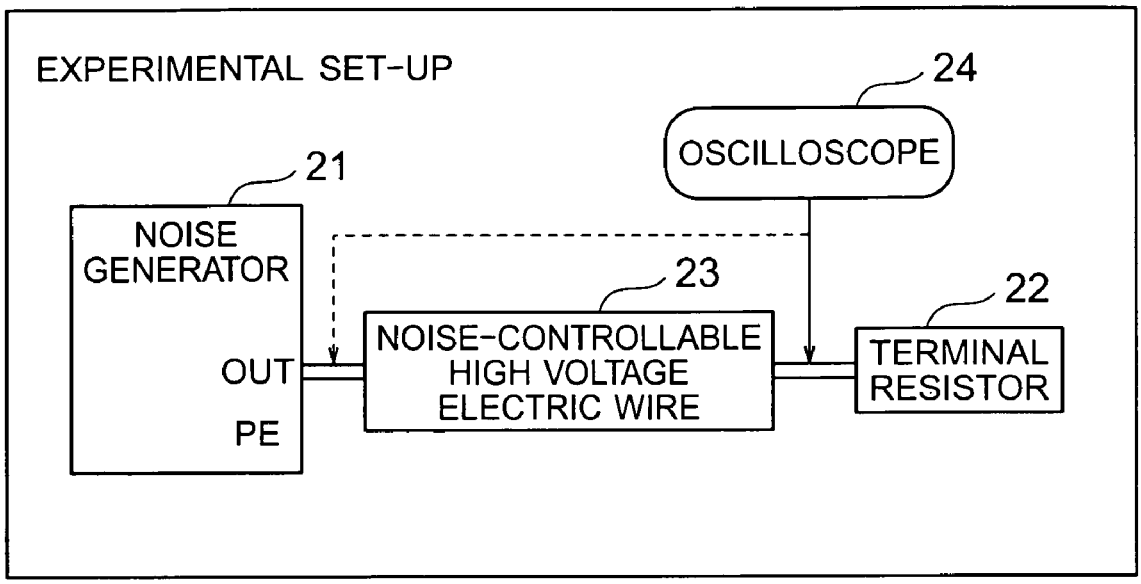
FIG. 3B
FIG. 3C
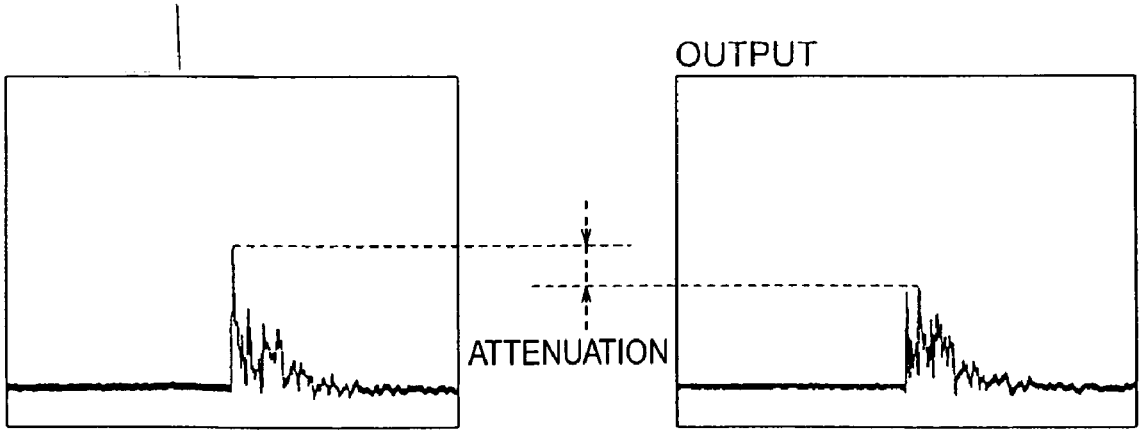

NOISE-CONTROLLABLE HIGH VOLTAGE ELECTRIC WIRE

BACKGROUND OF THE INVENTION (1) Field of the Invention

The present invention relates to a noise control of a high voltage electric wire, which is thick and allows a large current to flow therethrough.

(2) Description of the Related Art

A high voltage electric wire is used to supply electric power to a motor for traveling, which is mounted on an electric motor vehicle, a hybrid motor vehicle and so on (see Japanese Patent Application Laid-Open No. 2005-151712). The high voltage electric wire is a thick electric wire such as an electric wire having a central conductor of 20 mm square. The high voltage electric wire is electrically insulated from a low voltage electric wire. In the high voltage electric wire, a wire of a plus circuit and a wire of a minus circuit are arranged in parallel to each other.

A high voltage subjected to switching is applied on a high voltage electric wire. As for the high voltage electric wire, it is an important point that an excellent noise control effect can be obtained in a frequency range from a low frequency to a high frequency.

Since a large current flows through the high voltage electric wire, a magnetic field is generated in the vicinity of the high voltage electric wire. Depending on a case or a situation, such a magnetic field becomes a subject of restriction and requires to be controlled. As a method of controlling the magnetic field, to shield the magnetic field with a high magnetic permeability material is known. For example, a ferrite core, which has a high specific resistivity against a high frequency wave, is used. However, such a method has a problem that a product price becomes high and a problem, that is, a lack of flexibility and a lack of mounting workability.

As a technique to prevent an electromagnetic wave noise from radiating to the outside, to twist two wires (i.e. electric wires) together to form a twisted pair of the wires is generally known. That is, when a wire to form a plus circuit and a wire to form a minus circuit are twisted together, an action to remove the electromagnetic wave noise is increased. However, when the technique described above is to be applied, there is a problem that since the high voltage electric wire is thick, these two wires cannot be twisted together well so as to have the effect described above, that is, when being twisted together, it is impossible to obtain a small twist pitch.

SUMMARY OF THE INVENTION

It is therefore an objective of the present invention to solve the above problem and to provide a noise-controllable high voltage electric wire, by which an electromagnetic wave noise can be effectively removed despite that the high voltage electric wire is a thick wire.

In order to attain the above objective, the present invention is to provide a noise-controllable high voltage electric wire that is a pair of thick high voltage electric wires, through which a large current flows, consisting of a plus circuit and a minus circuit, said pair of the thick high voltage electric wires including:

a plurality of thin electric wires for the plus circuit; and a plurality of thin electric wires for the minus circuit, wherein each thin electric wire for the plus circuit and a corresponding thin electric wire for the minus circuit are twisted together so as to form a plurality of twisted pairs of the electric wires, wherein the plurality of the twisted pairs of the electric wires are bundled up.

With the construction described above, the pair of the thick high voltage electric wires has a part which removes an electromagnetic wave noise. Said part is formed by twisting each thin electric wire for the plus circuit and a corresponding thin electric wire for the minus circuit together and bundling up the plurality of the twisted pairs of the electric wires.

According to the present invention, by bundling up the plurality of the twisted pairs of the electric wires, a small twist pitch that is hardly obtained with a thick electric wire can be obtained while each effect of removing the electromagnetic wave noise per twisted pair of the electric wire is maintained. Further, by bundling up the plurality of the twisted pairs of the electric wires, such a bundled twisted pairs of the electric wires can be handled in the same manner as that of the thick electric wire.

That is, according to the present invention, a noise-controllable high voltage electric wire, by which an electromagnetic wave noise can be effectively removed despite that the high voltage electric wire is a thick wire, can be obtained. Further, the electromagnetic wave noise can be removed without using a material having a high magnetic permeability. Furthermore, the flexibility and the mounting workability as described above can be improved in comparison with a case in which a material having a high magnetic permeability is used.

A middle part of the pair of the thick high voltage electric wires includes the plurality of the thin electric wires for the plus circuit and the plurality of the thin electric wires for the minus circuit.

With the construction described above, the pair of the thick high voltage electric wires has a part, which removes an electromagnetic wave noise, in the middle of the pair of the thick high voltage electric wires. The middle part, that is, the part which removes an electromagnetic wave noise, is a part at which the electromagnetic wave noise is required to be removed. The middle part may correspond to a portion of the high voltage electric wire or a major part of the high voltage electric wire except an end part of the high voltage electric wire, for example. That is, according to the present invention, the electromagnetic wave noise of such a portion of the high voltage electric wire or such a major part of the high voltage electric wire except an end part of the high voltage electric wire, for example, can be effectively removed.

The noise-controllable high voltage electric wire further includes a pair of connectors each including:

a terminal for the plus circuit to connect a conductor of the high voltage electric wire forming the plus circuit with conductors of the plurality of the thin electric wires for the plus circuit; and a terminal for the minus circuit to connect a conductor of the high voltage electric wire forming the minus circuit with conductors of the plurality of the thin electric wires for the minus circuit.

With the construction described above, the connector is used to connect the bundled plurality of the twisted pairs of the electric wires and the high voltage electric wire with each other. Thereby, excellent connection between the twisted pairs of the electric wires and the high voltage electric wire can be attained.

With the construction described above, by using the connector, the bundled plurality of the twisted pairs of the electric wires and the high voltage electric wire can be easily connected with each other.

The terminal for the plus circuit includes: a busbar for the plus circuit to which the conductor of the high voltage electric wire forming the plus circuit is connected; and a terminal fitting for the plus circuit provided at an end of the thin electric wires for the plus circuit, wherein the busbar for the plus circuit has a branch structure and includes a plurality of tabs for the plus circuit to which the terminal fitting for the plus circuit is connected;

wherein the terminal for the minus circuit includes: a busbar for the minus circuit to which the conductor of the high voltage electric wire forming the minus circuit is connected; and a terminal fitting for the minus circuit provided at an end of the thin electric wires for the minus circuit, wherein the busbar for the minus circuit has a branch structure and includes a plurality of tabs for the minus circuit to which the terminal fitting for the minus circuit is connected.

With the construction described above, branching and collecting is carried out within the connector by the busbar for the plus circuit and the busbar for the minus circuit. Therefore, the branching and the collecting can be easily carried out. A small twist pitch that is hardly obtained with a thick electric wire can be obtained.

The number of the plurality of the thin electric wires for the plus circuit is determined so that a total cross sectional area of the conductors of the plurality of the thin electric wires for the plus circuit corresponds to a cross sectional area of the conductor of the high voltage electric wire forming the plus circuit, wherein the number of the plurality of the thin electric wires for the minus circuit is determined so that a total cross sectional area of the conductors of the plurality of the thin electric wires for the minus circuit corresponds to a cross sectional area of the conductor of the high voltage electric wire forming the minus circuit.

With the construction described above, the bundled twisted pairs of the electric wires can be handled in the same manner as that of the thick electric wire.

BRIEF DESCRIPTION OF THE DRAWINGS

FIG. 3A is an experimental block diagram to measure an attenuation effect of a noise-controllable high voltage electric wire of the present invention;

FIG. 3B is a waveform upon inputting associated with an attenuation effect of a noise-controllable high voltage electric wire of the present invention; and FIG. 3C is a waveform upon outputting associated with an attenuation effect of a noise-controllable high voltage electric wire of the present invention.

DESCRIPTION OF THE PREFERRED EMBODIMENTS

In the following, the preferred embodiments of the present invention will be explained with reference to the attached drawings.

Figure 1:
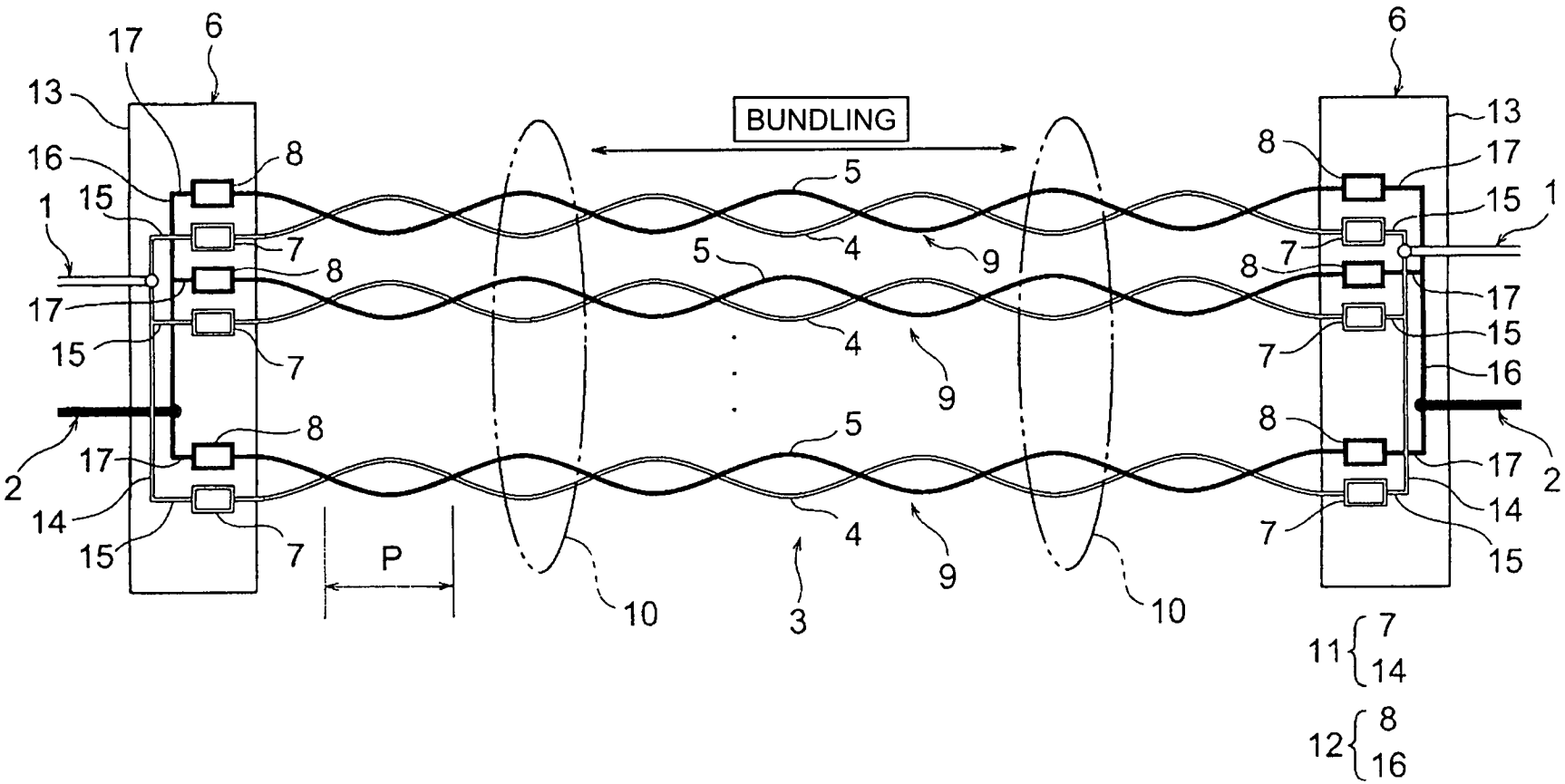
FIG. 1 is a schematic illustration of a noise-controllable high voltage electric wire according to a preferred embodiment of the present invention.
Figure 2:
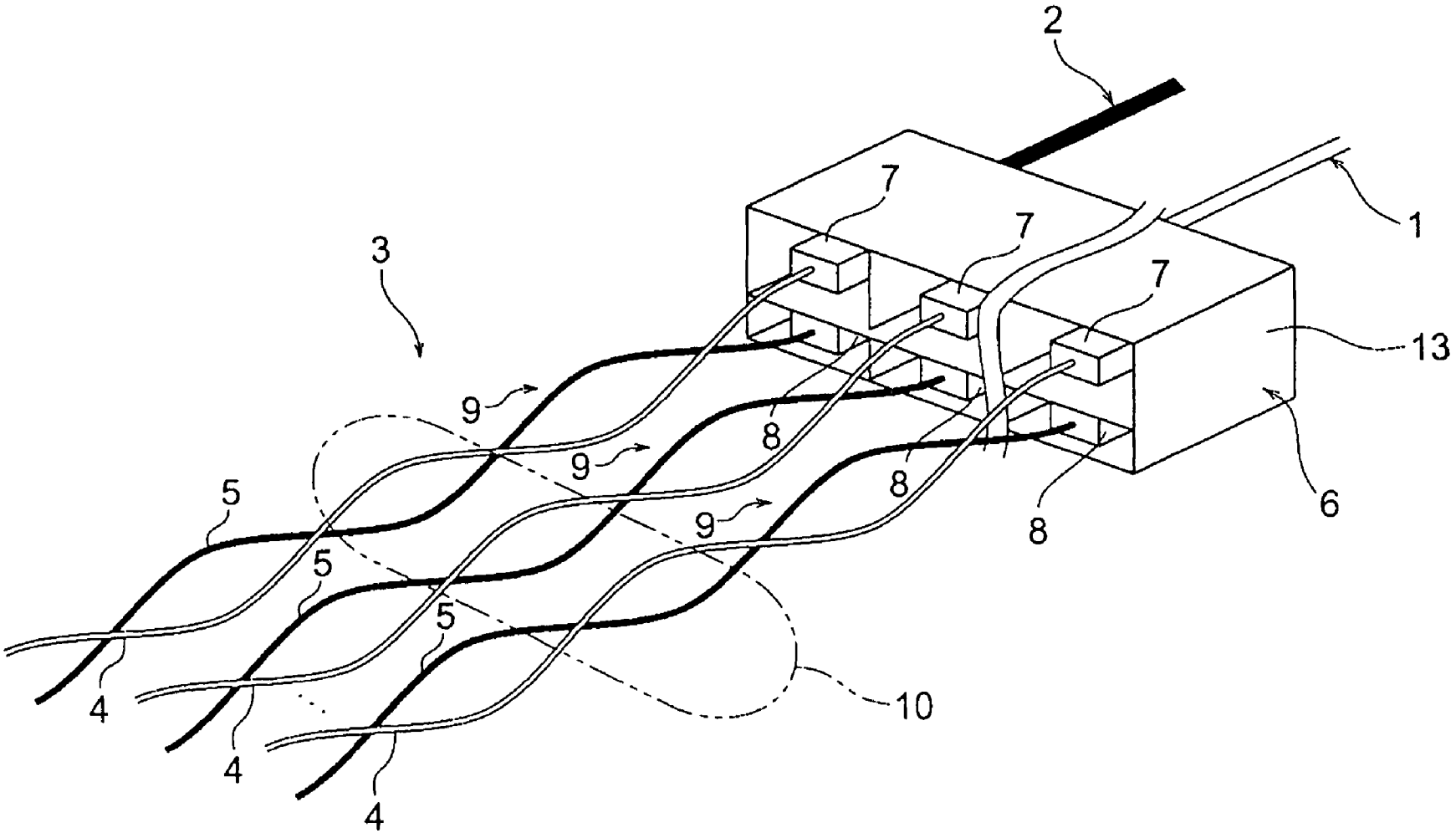
FIG. 2 is a schematic perspective view illustrating a noise-controllable high voltage electric wire according to a preferred embodiment of the present invention.

In FIGS. 1 and 2, a reference numeral 1 denotes a high voltage electric wire which forms a plus circuit (hereinafter, high voltage electric wire 1), while a reference numeral 2 denotes a high voltage electric wire which forms a minus circuit (hereinafter, high voltage electric wire 2). Each high voltage electric wire 1, 2 is a thick electric wire such as an electric wire having a conductor (i.e. central conductor) of 20 mm square, for example. For example, the high voltage electric wires 1 and 2 are arranged between a motor for traveling and an inverter control part in an electric motor vehicle so as to connect them to each other. The high voltage electric wires 1 and 2 become electromagnetic wave noise-controllable high voltage electric wires by possessing a characteristic part explained later in a middle part 3 of the high voltage electric wires 1 and 2.

The middle part 3 of the high voltage electric wire 1, 2 includes a plurality of thin electric wires 4 for the plus circuit, a plurality of thin electric wires 5 for the minus circuit, and a pair of connectors 6. The middle part 3 is a part at which the electromagnetic wave noise is required to be removed.

Each thin electric wire 4 for the plus circuit is a thin electric wire (for example, having a conductor of 1.25 mm square, 0.5 mm square or the like). The number of the plurality of the thin electric wires 4 for the plus circuit is such that a total cross sectional area of the conductors of the plurality of the thin electric wires 4 for the plus circuit corresponds to a cross sectional area of a conductor of the high voltage electric wire 1 which forms the plus circuit. A terminal fitting is attached to an end of each thin electric wire 4 for the plus circuit. The terminal fitting is a crimp contact terminal 7.

Each thin electric wire 5 for the minus circuit is a thin electric wire (for example, having a conductor of 1.25 mm square, 0.5 mm square or the like). The number of the plurality of the thin electric wires 5 for the minus circuit is such that a total cross sectional area of the conductors of the plurality of the thin electric wires 5 for the minus circuit corresponds to a cross sectional area of a conductor of the high voltage electric wire 2 which forms the minus circuit. A terminal fitting is attached to an end of each thin electric wire 5 for the minus circuit. The terminal fitting is a crimp contact terminal 8 (which is the same as the crimp contact terminal 7 described above).

Each thin electric wire 4 for the plus circuit and a corresponding thin electric wire 5 for the minus circuit are twisted together. By this twisting, the middle part 3 forms a plurality of twisted pairs 9 of the electric wires. Its twist pitch P is set to be, for example, from 10 mm to 15 mm. The plurality of the twisted pairs 9 of the electric wires are bundled up with maintaining their condition. A reference numeral 10 schematically shows a bundle of the plurality of the twisted pairs 9 of the electric wires. By bundling up the plurality of twisted pairs 9 of the electric wires, the middle part 3 of the high voltage electric wire 1, 2 can be handled in the same manner as that of the thick electric wire.

The connector 6 includes: a terminal 11 for the plus circuit to connect the conductor of the high voltage electric wire 1 with the respective conductors of the plurality of thin electric wires 4 for the plus circuit; a terminal 12 for the minus circuit to connect the conductor of the high voltage electric wire 2 with the respective conductors of the plurality of thin electric wires 5 for the minus circuit; and a connector housing 13 to receive the terminal 11 for the plus circuit and the terminal 12 for the minus circuit. The connector 6 is one of means for connecting a thick electric wire with thin electric wires. That is, the means may be caulking, welding, solder joining, thermocompression bonding, friction welding (i.e. ultrasonic bonding) and so on.

The terminal 11 for the plus circuit includes a busbar 14 for the plus circuit to be connected to the conductor of the high voltage electric wire 1 and the crimp contact terminals 7 provided at respective ends of the thin electric wires 4 for the plus circuit. The busbar 14 for the plus circuit is formed in a comb teeth in its plan view. The busbar 14 for the plus circuit has a branch structure including a plurality of tabs 15 for the plus circuit to be connected to the respective crimp contact terminals 7. Each crimp contact terminal 7 includes an electric contact part to be inserted into and connected to the corresponding tab 15 for the plus circuit and a electric wire connecting part to be crimp-contacted with the conductor of the thin electric wire 4 for the plus circuit.

The terminal 12 for the minus circuit includes a busbar 16 for the minus circuit to be connected to the conductor of the high voltage electric wire 2 and the crimp contact terminals 8 provided at respective ends of the thin electric wires 5 for the minus circuit. The busbar 16 for the minus circuit is formed in a comb teeth in its plan view. The busbar 16 for the minus circuit has a branch structure including a plurality of tabs 17 for the minus circuit to be connected to the respective crimp contact terminals 8. Each crimp contact terminal 8 includes an electric contact part to be inserted into and connected to the corresponding tab 17 for the minus circuit and a electric wire connecting part to be crimp-contacted with the conductor of the thin electric wire 5 for the minus circuit.

The connector housing 13 is made of electrically insulating synthetic resin and formed so as to receive and hold the terminal 11 for the plus circuit and the terminal 12 for the minus circuit. For example, the connector housing 13 is provided with terminal-receiving chambers formed in two-steps situated up and down, wherein the upper step receives the terminal 11 for the plus circuit and the lower step receives the terminal 12 for the minus circuit.

The connector 6 may be constructed with a male connector and a female connector, like a known electrical connector.

The thin electric wire 4 for the plus circuit and the thin electric wires 5 for the minus circuit, as a pair of the plus circuit and the minus circuit, are twisted together so as to form the twisted pair 9 of the electric wires. A plurality of the twisted pairs 9 of the electric wires are bundled up so that a total cross sectional area of the conductors of the plurality of the twisted pairs 9 of the electric wires corresponds to a cross sectional area of the conductor of the high voltage electric wire 1 or 2. Ends of the respective electric wires are assembled into two groups separately, that is, into a group for the plus circuit and into a group for the minus circuit, so that each assembled group can be handled in the same manner as that of the thick electric wire. In the connector 6, two circuits consisting of the plus circuit and the minus circuit branch therefrom. Thus, by bundling up the plurality of the twisted pairs 9 of the electric wires, a small twist pitch that is hardly obtained with a thick electric wire can be attained while each effect of removing the electromagnetic wave noise per twisted pair 9 of the electric wire is maintained.

In the following, effects found by experiments as to a noise-controllable high voltage electric wire according to the present invention will be explained with reference to FIGS. 3A-3C.

As shown in FIG. 3A, a noise generator 21 is connected to a terminal resistor 22 through a noise-controllable high voltage electric wire 23 according to the present invention and an oscilloscope 24 is connected to the noise-controllable high voltage electric wire 23 in the vicinity of the noise generator 21. In this case, a waveform upon inputting shown in FIG. 3B associated with an attenuation effect of the noise-controllable high voltage electric wire 23 was obtained.

On the other hand, when the oscilloscope 24 is connected to the noise-controllable high voltage electric wire 23 in the vicinity of the terminal resistor 22, a waveform upon outputting shown in FIG. 3C associated with the attenuation effect of the noise-controllable high voltage electric wire 23 was obtained.

From the waveforms shown in FIGS. 3B and 3C, it was found that an attenuation effect could be obtained by the noise-controllable high voltage electric wire 23 according to the present invention. (The actual observed attenuation was an attenuation of 2.6 dB.) It was found that the noise-controllable high voltage electric wire 23 according to the present invention was a functional electric wire.

As explained referring to FIGS. 1-3C, according to the present invention, an electromagnetic wave noise can be effectively removed despite that the high voltage electric wire is a thick wire.

Further, according to the present invention, an excellent noise control effect can be obtained in a wide frequency range from a low frequency to a high frequency. Furthermore, since an effect to remove a magnetic field at a low frequency can be expected, therefore noise-control can be carried out without using a magnetic shielding material. Concerning a whole system, since electromagnetic wave noise hardly leaks out to the-outside, therefore a risk of malfunction can be reduced. As for a portion where the electromagnetic wave noise cannot be fully removed, it is necessary to shield by using a braid. However, even in such a case, only less shielding is necessary.

The aforementioned preferred embodiments are described to aid in understanding the present invention and variations may be made by one skilled in the art without departing from the spirit and scope of the present invention.

What is claimed is:

1. A noise-controllable high voltage electric wire comprising:

(a) a pair of thick high voltage electric wires, through which a large current flows, one of the thick high voltage electric wires forming a plus circuit and another thereof forming a minus-circuit;

(b) a plurality of thin electric wires for the plus circuit;

(c) a plurality of thin electric wires for the minus circuit, each thin electric wire for the plus circuit and a corresponding thin electric wire for the minus circuit being twisted together so as to form a plurality of twisted pairs of the electric wires, and the plurality of the twisted pairs of the electric wires being bundled up; and (d) a pair of connectors each connecting the thick high voltage electric wires to the thin electric wires of the bundled twisted pairs such that the bundled twisted pairs constitute a middle part of the pair of the thick high voltage electric wires.

2. The noise-controllable high voltage electric wire according to claim 1 wherein the pair of connectors each include:

a terminal for the plus circuit to connect a conductor of the high voltage electric wire forming the plus circuit with conductors of the plurality of the thin electric wires for the plus circuit; and a terminal for the minus circuit to connect a conductor of the high voltage electric wire forming the minus circuit with conductors of the plurality of the thin electric wires for the minus circuit.

3. The noise-controllable high voltage electric wire according to claim 2, wherein the terminal for the plus circuit includes: a busbar for the plus circuit to which the conductor of the high voltage electric wire forming the plus circuit is connected; and a terminal fitting for the plus circuit provided at an end of the thin electric wires for the plus circuit, wherein the busbar for the plus circuit has a branch structure and includes a plurality of tabs for the plus circuit to which the terminal fitting for the plus circuit is connected;

wherein the terminal for the minus circuit includes: a busbar for the minus circuit to which the conductor of the high voltage electric wire forming the minus circuit is connected; and a terminal fitting for the minus circuit provided at an end of the thin electric wires for the minus circuit, wherein the busbar for the minus circuit has a branch structure and includes a plurality of tabs for the minus circuit to which the terminal fitting for the minus circuit is connected.

4. The noise-controllable high voltage electric wire according to claim 1, wherein the number of the plurality of the thin electric wires for the plus circuit is determined so that a total cross sectional area of the conductors of the plurality of the thin electric wires for the plus circuit corresponds to a cross sectional area of the conductor of the high voltage electric wire forming the plus circuit, wherein the number of the plurality of the thin electric wires for the minus circuit is determined so that a total cross sectional area of the conductors of the plurality of the thin electric wires for the minus circuit corresponds to a cross sectional area of the conductor of the high voltage electric wire forming the minus circuit.

* * * * *